United States Patent [19]

Mak

[11] 4,066,211

[45] Jan. 3, 1978

[54] MODEL TRACK SECTION

[76] Inventor: Sze Hong Mak, 57 Ma Tau Wai Road "H" Ground Floor, Kowloon, Hong Kong

[21] Appl. No.: 660,994

[22] Filed: Feb. 24, 1976

[51] Int. Cl.[2] ..... A63H 19/30

[52] U.S. Cl. ..... 238/10 F; 46/1 K

[58] Field of Search ..... 238/10 E, 10 F; 104/53, 104/6 C; 46/1 K, 216; 339/61 R, 61 C, 61 L, 61 M, 151 M, 91 R; 403/361, 364, 381; 191/22 C

[56] References Cited

U.S. PATENT DOCUMENTS

| | | | |
|---|---|---|---|
| 2,832,943 | 4/1958 | Cutler | 403/364 X |
| 3,206,122 | 9/1965 | Frisbie et al. | 191/22 C |
| 3,243,120 | 3/1966 | Lingard et al. | 238/10 F |
| 3,750,945 | 8/1973 | Warr | 104/53 X |
| 3,753,201 | 8/1973 | Ohman | 339/151 M X |
| 3,827,007 | 7/1974 | Fairbairn et al. | 339/91 R X |
| 3,830,426 | 8/1974 | Martin | 238/10 F |

*Primary Examiner*—Stanley H. Tollberg
*Assistant Examiner*—Fred A. Silverberg
*Attorney, Agent, or Firm*—Robert K. Youtie

[57] ABSTRACT

A model track section for model vehicles, which is releasably interengageable in end-to-end connection with a like track section, wherein the section includes a generally flat bed having thereon a pair of longitudinal rails, one end of the bed being cut away in the space between the adjacent rail ends and having resilient backing portions on outer sides of the rail ends, the other bed end having a pair of laterally spaced cutouts or openings on outer sides of the associated rail ends, which latter rail ends are configured for contacting engagement between the first mentioned rail ends upon end-to-end connection of a pair of such sections.

10 Claims, 4 Drawing Figures

MODEL TRACK SECTION

BACKGROUND OF THE INVENTION

As is well known to those versed in the art of model vehicles and track, prior track constructions have presented certain problems, some being difficult to assemble and disassemble as involving separate retaining pieces, others requiring relatively precise manipulations in predetermined sequence requiring special training and skills, still others involving physical forces and dexterity beyond average capabilities. Prior model track constructions were also subject to functional problems under normal conditions of use, including vibrating loose, breakage of holding parts, lack of electrical connection due to corrosion and dirt, and excessive material requirements to achieve satisfactory strength and durability. Certain prior track constructions also necessitated construction in multiple lanes to achieve interfittability, requiring considerable overlap and excess length at track connection joints, and involving complex and unnatural manual operations for connection and disconnection.

SUMMARY OF THE INVENTION

Accordingly, it is an important object of the present invention to provide a track construction for model vehicles which overcomes the above-mentioned difficulties, is readily connectible and disconnectible from like track sections by the simplest and most natural manual operation of end-to-end aligned pushing and pulling, respectively. The instant track construction requires no loose or separate parts susceptible of loss, and involves only minimal physical forces in the hereinbefore described simplest manipulations, namely straight line pushing and pulling.

It is still a further object of the present invention to provide a track section of the type described which effectively resists adverse effects of vibration, the electrical connectors being at all times maintained in intimate conductive contact and automatically wiped clean and free of dirt and corrosion upon each assembly and disassembly.

It is still another object of the present invention to provide a track section having the advantageous characteristics mentioned in the preceding paragraphs, wherein a single lane of track may be symmetrical about its longitudinal centerline, so that track sections of model roadways may be complete with a single lane only, if desired, and wherein the connecting structure at each track end involves a minimum of overlap to reduce the ratio of overall track section length to usable track section length, for economies in space and materials.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
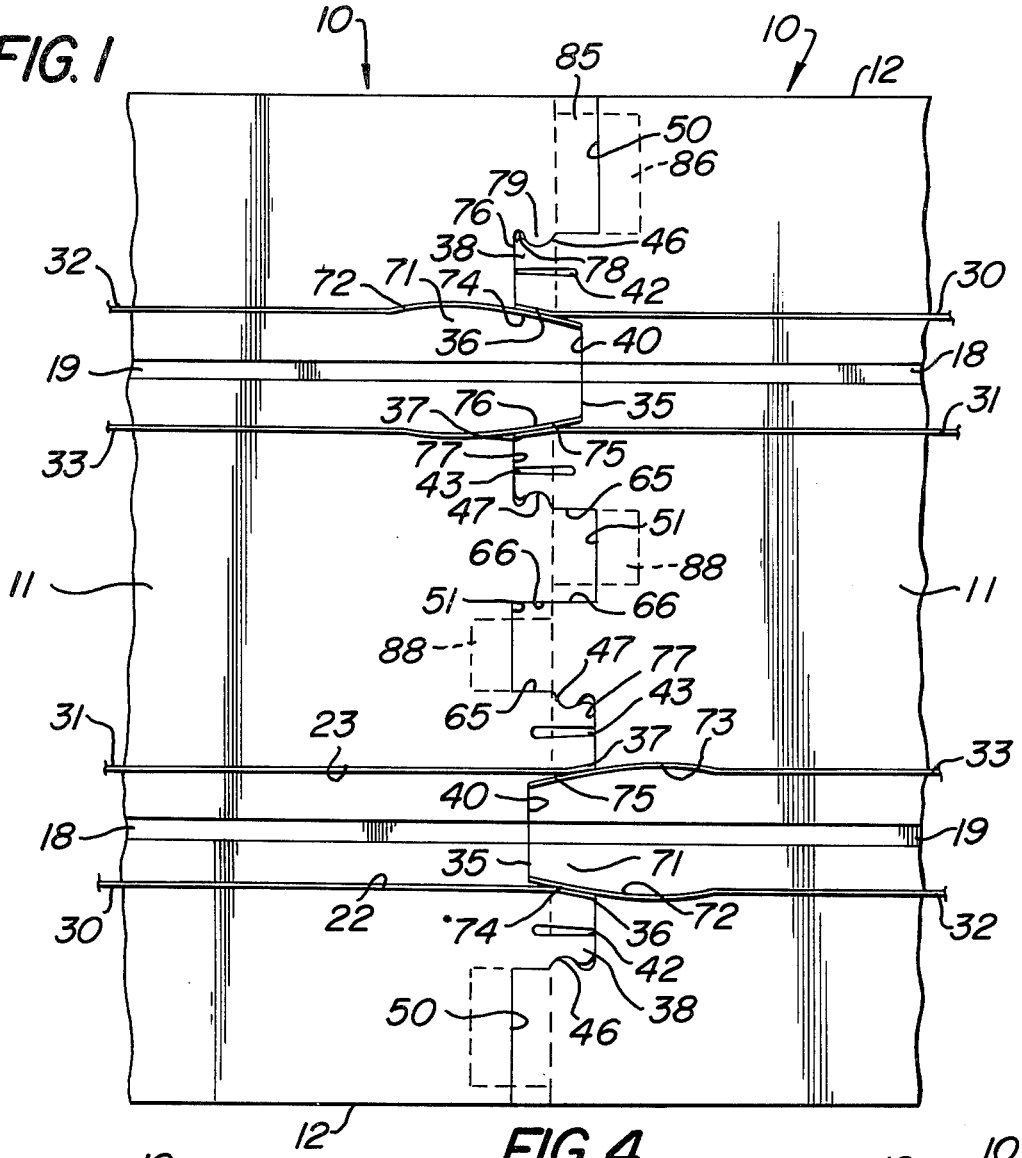
FIG. 1 is a top plan view showing a pair of track sections of the present invention in end-to-end assembled relation, the nonadjacent ends being broken away to facilitate enlargement and clarity.
Figure 2:
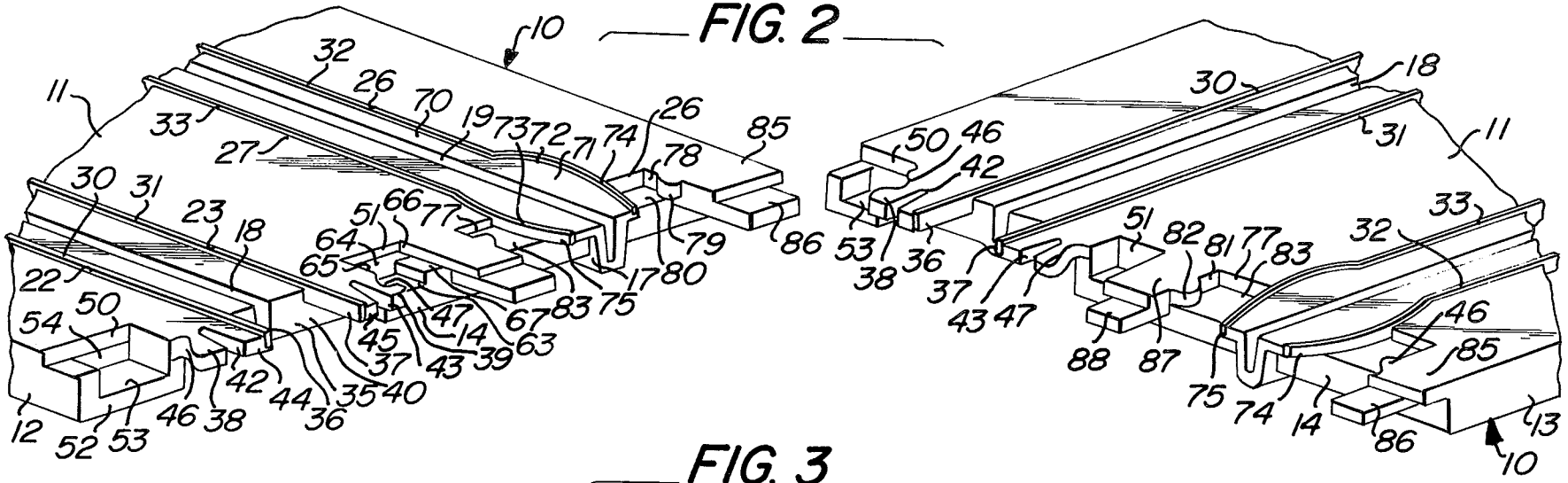
FIG. 2 is a top perspective view illustrating the track sections of FIG. 1 as disconnected from each other.

Referring now more particularly to the drawings, and specifically to FIGS. 1 and 2 thereof, a pair of substantially identical model track sections are each there generally designated 10, each track section having its opposite ends identical, so that only a single end need be shown and described.

Each track section 10 may include a generally elongate, substantially flat bed or body 11 which may have along opposite side edges a pair of longitudinally extending, depending sides or walls 12 and 13, and along each end extending laterally thereacross a depending end wall 14. If desired, suitable ribbing may be provided on the underside of flat body or bed 11. Formed in the body 11, extending longitudinally therealong and opening through opposite end walls 14 are a pair of laterally spaced vehicle guiding formations defining downwardly protuberant ribs 16 and 17 on the underside of body 11 and guideways or grooves 18 and 19 on the upper side of the body 11, opening upwardly therefrom and longitudinally outwardly through opposite ends thereof. Also formed in the flat body or bed 11, extending longitudinally along and on opposite sides of the depressed guide rib, groove 16, 18, are a pair of depressed ribs 20 and 21 projecting on the underside of the body and defining upwardly facing, open-ended grooves 22 and 23, respectively on the upper side of the body or bed 11. Similarly extending longitudinally along and on opposite sides of the guide rib, groove 17, 19, depending from the underside of the body are a pair of grooves 24 and 25 defining on the upper surface of the body or bed respective upwardly facing grooves 26 and 27. As will appear presently, the pairs of grooves 22 and 23 on opposite sides of the guideway 18 are adapted to receive a pair of electrically conductive or metallic strips or rails 30 and 31, while the additional grooves 26 and 27 associated with the other guideway 19 are adapted to receive an additional pair of metal or otherwise electrically conductive strips or rails 32 and 33.

The rails 30–33 are employed, as is well known, to conduct electricity to the propulsion system of a vehicle moving along the track section and guided therealong by a vehicle guide member riding in the associated guideway 18, 19. As will be apparent to those skilled in the art, the entire track structure, with the exception of rails 30–33 may be integrally fabricated of suitable nonconductive material, such as plastic, as by injection molding or otherwise, as desired. The rails 30–33 may be inserted in their respective receiving grooves 22, 23, 26, 27 and suitably secured therein, as by staking, or may be molded in place, or otherwise assembled with the bed 11.

It is, of course, appreciated that in a track section 10, such as that illustrated wherein there are provided two lanes or double track, that both opposite end regions of a single track section are identical for interfitting connection with adjacent ends of like track sections, so that it is not necessary to show both ends of a single track section. Stated otherwise, the end portions of rails 22, 23 and their associated bed parts, as will appear presently, which are not shown in the drawings, are identical to the end portions of rails 32, 33 and associated bed regions as shown in the drawings.

Figure 4:
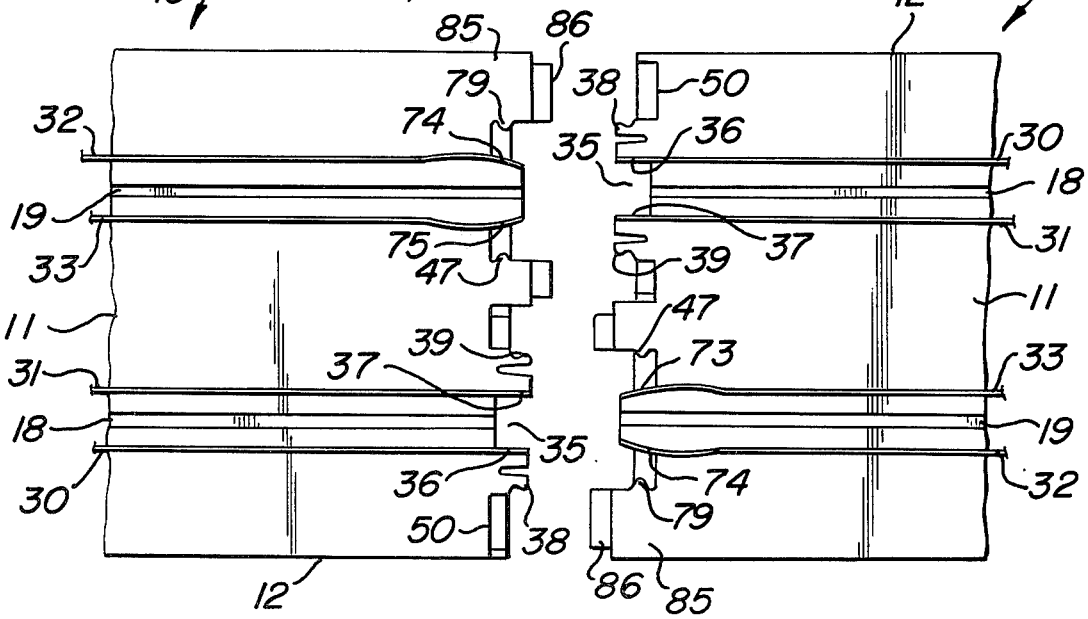
FIG. 4 is a top plan view of the disconnected track sections of FIG. 3.
Figure 3:
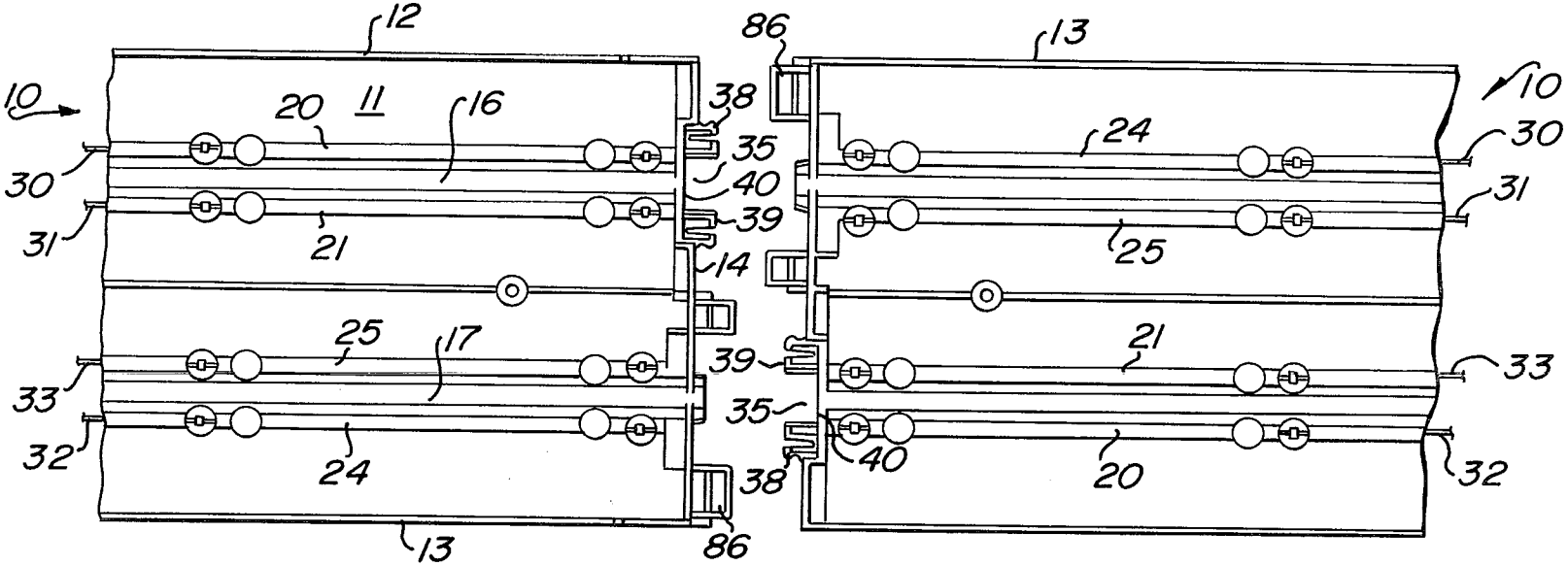
FIG. 3 is a bottom plan view of the track sections of FIG. 1 disconnected.

The bed end region between rails 30 and 31 is cut away or open, as at 35 in FIGS. 3 and 4, so that the terminal end portions 36 and 37 of respective rails 30 and 31 are exposed on their inner, facing sides. The bed end cutout or opening 35 may be of generally rectangular configuration, leaving on opposite sides longitudinally outwardly projecting bed end portions 38 and 39. The section end wall 14 is offset longitudinally inwardly or recessed, as at 40 extending across the cutout or opening 35 and beneath the adjacent projecting bed end portions 39 and 38, as best seen in FIG. 3. The projecting bed end portions 38 and 39 are respectively in laterally supporting or backing engagement with rail end portions 36 and 37. Further, the projecting bed end portions 38 and 39 are each formed with a longitudinally inwardly extending slit, groove or notch, as at 42 and 43, respectively. That is, the longitudinally inwardly extending slits or grooves 42 and 43 are each located laterally medially of its respective projecting bed end portions 38 and 39, and subdivide the same to define of the bed portion between each slit and its adjacent rail a resiliently flexible rail backing finger. The bed end projection 38 thereby provides a resilient rail backing finger 44 in resilient backing engagement with the terminal rail portion 36; and, the bed end projection 38 provides a resiliently flexible backing finger 45 in flexible supporting engagement with its adjacent rail terminal portion 37. In undistended, normal condition, the terminal rail portions 36 and 37 may be generally straight extensions of their respective rails 30 and 31, and resiliently yieldably supported against laterally outward deflection by their respective backing fingers 44 and 45.

On the outer sides of respective bed end projections 38 and 39, laterally remote from respective rail end portions 36 and 37, there may be releasable holding edge formations, as at 46 and 47, respectively. As illustrated, the holding formations 46 and 47 may be recesses, as for receiving projections, or other suitable holding formations.

Laterally outwardly of respective projecting bed end portions 38 and 39 are pair of additional bed end region cutouts or openings, as at 50 and 51. In particular, a bed end cutout or opening 50 is of generally rectangular formation just outward of bed end projection 38, opening through the adjacent side edge of the bed and beyond bed side wall 12. In addition, the bed end wall region 52 adjacent to the cutout 50 is recessed downwardly, as at 53, and opens longitudinally, as at 54, beneath the adjacent bed portion.

The inner bed end cutout or opening 51, adjacent to the inner bed end projection 39, is similarly of generally rectangular configuration, the adjacent portion of bed end wall 14 being downwardly recessed, as at 63, to open upwardly into the cutout or opening 51, and define a longitudinally inward opening 64. However, the upwardly facing recess 63 is not laterally coextensive with the bed opening 51. Rather, the recess 63 may extend generally from one side wall 65 of the bed projection 39 toward and terminate short of the other side 66 of the cutout 51, thereby leaving of the end wall 14 an upwardly facing shoulder 67.

As mentioned hereinbefore, and as is conventional in the art, the opposite end regions of rails 30 and 31, and the associated end regions of bed 11 (not shown in the drawing) are identical to the illustrated rail end regions of rails 32 and 33 and their associated bed end regions. Of course, this is well known to those versed in the art, so that illustration of only a single bed end region is sufficient. However, it is appreciated that a track section may employ only a single lane or single pair of rails, if desired, in which case the track section would include only one pair of rail end portions at each end, the terminal rail portions 36 and 37 and associated bed end portions at one end, and the illustrated end portions of rails 32 and 33 and associated bed end portions at the other end. As will be apparent, such a single lane or track may constitute one-half of a track section 10 as subdivided along the longitudinal centerline thereof, the track section being symmetrical thereabout.

Considering FIG. 2 again, the rails 32 and 33, being electrically conductive or metallic strips, are located in respective grooves 26 and 27 and on opposite sides of an intermediate bed region 70 which includes the guideway or groove 19. The end portion of intermediate bed region 70, as at 71, is somewhat bulbuous, as having outwardly bowed or convexly arcuate sides or edges 72 and 73, which provide backing or reinforcement to comformably curved and abutting terminal portions 74 and 75 of respective rails 32 and 33. As best seen in FIGS. 2 and 4, the terminal rail portions 74 and 75 are arcuately bowed to terminate in convergent relation supported against the adjacent edges 72 and 73 of bed portion 71. The bed 11, on opposite sides of the terminal rail portions 74 and 75, is cut away or open to define respective cutouts or openings 76 and 77. That is, the inwardly extending bed end opening 76 is generally trapezoidal, by reason of the diagonally extending terminal rail region 74 defining one side of the opening. The outer side 78 of the opening 76, opposite to the exposed terminal rail portions 74, is provided with a holding formation 79, which may assume the form of a detent or projection. The adjacent portion of end wall 14 defines the bottom, as at 80 of the cutout or opening 76.

The cutout or opening 77 of bed 11 is similar to the cutout 76, but on the opposite side of rails 32 and 33, having one terminal rail portion 75 defining one side of the opening 77. Opposite the exposed terminal rail portion 75, the opening 77 is defined by an edge 81 having thereon a holding formation 82, which in the illustrated embodiment may be a proturberance or detent, for a purpose appearing presently. The cutout or opening 77 is similar to the cutout or opening 76, wherein the adjacent portion of end wall 14 defines in the opening a bottom wall 83.

Remaining of the bed 11 laterally outwardly beyond the opening or cutout 76 is a bed end portion 85 terminating at its laterally outer side flush with the bed side wall 13. A longitudinal projection or tongue 86 extends from the region of end wall 14 beneath bed portion 85, and may have its inner side generally flush with the side wall or edge 87 of recess 76, its outer side being offset inwardly from the bed side wall 13.

Remaining between cutout or opening 77 and cutout or opening 51 is a bed end region 87 generally similar to the bed end region 85. Also similarly, projecting longitudinally outwardly from the region of bed end wall 14 beneath bed portion 87 is a tongue, extension 88, which is flush on one side with the side wall or edge 81 of cutout 87, and extends laterally therefrom to terminate short of the adjacent side edge 66 of cutout 51. Thus, bed end portion 87 overhangs laterally beyond tongue 88, and similarly bed end region 85 overhangs laterally beyond its nether tongue 86.

As best appears in FIG. 4, the lateral extent of the ends of rails 32 and 33 is less than the lateral extent of the ends of rails 30 and 31. Hence, the nondivergent, or convergent rail end portions 74 and 75 are adapted to enter between the nonconvergent or parallel rail end portions 36 and 37. In the condition shown in FIG. 4, the pair of track sections 10 are in end-to-end spaced alignment with each other, as just prior to connection. Necessary to effect connection is mere longitudinal or endwise movement toward each other, a simple pushing together procedure. In this procedure, each pair of rail end portions 74, 75 will enter into an opening or space 35 between an adjacent pair of rail end portions 36 and 37. The tapering rail end portions 74 and 75 will wipe against respective nontapering rail end portions 36 and 37 to clean the wiping portions and assure intimate electrical contact. Continued insertion of the convergent rail end portions 74 and 75 effects laterally outward distention or splaying of the nonconvergent rail end portions 36 and 37, the latter spreading resiliently yieldably by resilient outward flexure of respective backing fingers 44 and 45.

Simultaneously, the tongues 86 and 87 of each track section 10 enter into the openings 54 and 64 of the other track section, while each pair of bed extensions 38 and 39 enters into a respective pair of bed openings or cutouts 76 and 77. Also simultaneously, each generally central bed end region 87 enters into the opposite central bed opening 51.

As the tongues 86 and 88 enter beneath the bed 11, their engagement with the underside of the bed limits relative section movement in one direction, while their engagement with the recess bottom walls 53 and 63 limits relative swinging movement of the sections in the opposite direction. Also, the holding formations, such as protuberances 79 and 83 effect flexure of bed end projections 38 and 39 to snap engage into respective hollow formations 46 and 47. Thus, the connected pair of track sections are restrained against relative swinging movement, as well as undersired loosening or separation. However, deliberate separation against the holding force of interfitting formations 79, 83, 46 and 47 may be effected by mere pulling apart of a connected pair of sections.

It will now be appreciated that the device of the present invention provides a track section for model vehicles which is extremely simple in construction, may be generally symmetrical about a longitudinal centerline for multiple lane or double track employment, involves a minimum of overlap of connected track sections and involves only the simplest of straight pushing and pulling procedures for connecting and disconnecting track, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A model track section comprising a generally flat bed having one end region and an other end region, a pair of conductive rails on said bed longitudinally coextensive therewith and having a pair of adjacent facing sides and a pair of nonfacing sides, said one end region of said bed having a longitudinally inwardly extending opening substantially occupying the space between the adjacent facing sides of said rails, the other end region of said bed having a pair of longitudinally inwardly extending cutouts on the nonfacing sides of and containing said rails, the rail ends at said one bed end region being spaced apart a greater distance and the rail ends at said other bed end region being spaced apart a lesser distance for longitudinal insertion of the lesser spaced rail ends between a pair of greater spaced rail ends of a like track section when said track sections are moved in longitudinal end-to-end assembled relation, and resilient means associated with at least one of said greater and lesser spaced rail ends for deflection thereof upon said insertion. said resilient means comprising a longitudinally extending slit in said one end region of said bed spaced outwardly from each of said rails, the region of said bed between each of said slits and the rail adjacent to a respective slit defining a resilient backing portion.

2. A track section according to claim 1, said greater spaced rail ends being nonconvergent for receiving the lesser spaced rail ends of said like track section.

3. A track section according to claim 1, said lesser spaced rail end portions being nondivergent for entry between a pair of greater spaced rail ends of a like track section.

4. A model track section according to claim 3, said lesser spaced rail end portions being convergent at an angle having its bisector generally longitudinally of the track section for generally straight longitudinal assembling and disassembling movement of a pair of track sections.

5. A track section according to claim 1, in combination with snap formations on opposite bed end regions for interfitting engagement with opposite bed end regions of like track sections upon said longitudinal end-to-end assembly.

6. A track section according to claim 5, certain of said snap formations being in at least one of said cutouts spaced from said at least one of said greater and lesser spaced rail ends.

7. A model track section according to claim 1, said other bed end portion pair of inwardly extending cutouts being configured to conformably receive the spaced bed portions at said one bed end on opposite sides of said rails, and interfitting snap formations on said spaced bed portions and in said pair of inwardly extending cutouts.

8. A model track section according to claim 7, said interrail cutout and said pair of cutouts being of approximately the same depth for approximately equal and minimum overlap of connected track sections.

9. A track section comprising a generally flat bed having one end region and an other end region, a pair of conductive rails on said bed longitudinally coextensive therewith and having a pair of adjacent facing sides and a pair of nonfacing sides, said one end region of said bed having a longitudinally inwardly extending opening between the adjacent facing sides of said rails, the other end region of said bed having a pair of longitudinally inwardly extending cutouts along the nonfacing sides of said rails, the rail ends at said one bed end region being spaced apart a greater distance and the rail ends at the other bed end region being spaced apart a lesser distance for longitudinal insertion of the lesser spaced rail ends between a pair of greater spaced rail ends of a like track section when said track sections are moved in longitudinal end-to-end assembled relation, resilient means associated with at least one of said greater and lesser spaced rail ends for deflection thereof upon said insertion, and snap formations on opposite bed end regions for interfitting engagement with opposite bed end regions of like track sections upon said longitudinal end-to-end assembly, certain of said snap formations being in at least one of said cutouts spaced from said at least one of said greater and lesser spaced rail ends, said resilient means comprising a slit extending longitudinally inwardly from said one end region of said bed and spaced outwardly from each of said rails, the region of said bed between each of said slits and the rail adjacent to a respective slit defining a resilient backing portion.

10. A model track section according to claim 9, said one end region having a resiliently deflectable finger on the outer side of each slit, other of said snap formations being on at least one of said fingers for releasable snap interfitting engagement with said certain of said formations.

* * * * *